US010876814B1

(12) United States Patent
Visser

(10) Patent No.: US 10,876,814 B1
(45) Date of Patent: Dec. 29, 2020

(54) STORAGE CONTAINER FOR MOUNTING ON FIREARMS

(71) Applicant: Scott Dean Visser, Butler, TN (US)

(72) Inventor: Scott Dean Visser, Butler, TN (US)

( * ) Notice: Subject to any disclaimer, the term of this patent is extended or adjusted under 35 U.S.C. 154(b) by 0 days.

(21) Appl. No.: 16/825,474

(22) Filed: Mar. 20, 2020

(51) Int. Cl.
*F41C 23/22* (2006.01)

(52) U.S. Cl.
CPC ..... *F41C 23/22* (2013.01)

(58) Field of Classification Search
CPC ..... F41C 23/22
See application file for complete search history.

(56) References Cited

U.S. PATENT DOCUMENTS

D430,257 S 8/2000 Chang
7,640,690 B2 1/2010 Hines
8,091,265 B1 * 1/2012 Teetzel ..... F41C 23/16 42/72
8,156,679 B1 * 4/2012 Swan ..... F41G 11/003 42/124
8,353,123 B2 1/2013 Pullicar et al.
D752,169 S 3/2016 Merlino et al.
9,464,864 B2 10/2016 Merlino et al.
D781,983 S 3/2017 Wells
9,650,112 B1 * 5/2017 Milam ..... B63B 22/12
9,797,688 B2 10/2017 Kennair, Jr.
D860,375 S 9/2019 Chavez
2005/0279004 A1 * 12/2005 Woodmansee, III ..... F41G 1/00 42/146
2006/0288626 A1 * 12/2006 Kim ..... F41G 11/003 42/73
2007/0044365 A1 * 3/2007 Deken ..... F41B 5/14 42/146
2008/0040965 A1 * 2/2008 Solinsky ..... F41G 1/345 42/90
2009/0044439 A1 * 2/2009 Phillips ..... F41C 23/14 42/72
2009/0277069 A1 * 11/2009 Delmonico ..... F41G 11/003 42/105
2010/0154276 A1 * 6/2010 Kim ..... F41C 27/00 42/90
2011/0255270 A1 * 10/2011 Gross ..... F41G 1/36 362/110
2011/0283585 A1 * 11/2011 Cabahug ..... F41G 11/003 42/73
2012/0131837 A1 * 5/2012 Cabahug ..... F41C 27/00 42/84

(Continued)

FOREIGN PATENT DOCUMENTS

FR 3029616 A1 10/2016

OTHER PUBLICATIONS

Max Slowik, Power Up the Quad Rail: Introducing the New T.Worx M4 Power System, guns.com (Sep. 1, 2012 5:15 PM), https://www.guns.com/news/2012/09/01/t-worx-powered-rail-system (last accessed Mar. 20, 2020).

(Continued)

*Primary Examiner* — Michelle Clement
(74) *Attorney, Agent, or Firm* — Shane Cortesi

(57) ABSTRACT

A storage container for a firearm is described. The storage container may contain a female slot for attachment to a rail of the firearm as well as a rail for attachment to a slot of an external device. The storage container may be sealable by a removable cap to protect batteries and other contents from water.

23 Claims, 11 Drawing Sheets

(56) References Cited

U.S. PATENT DOCUMENTS

| | | | | |
|---|---|---|---|---|
| 2012/0266514 | A1* | 10/2012 | Michal | F41C 27/00 42/90 |
| 2013/0185978 | A1* | 7/2013 | Dodd | F41C 23/22 42/84 |
| 2014/0059911 | A1* | 3/2014 | Oh | F41C 23/22 42/16 |
| 2016/0209167 | A1* | 7/2016 | Wells | F41C 27/00 |
| 2019/0137213 | A1* | 5/2019 | Miller | F41C 23/14 |

OTHER PUBLICATIONS

TNVC Thermal Remote Battery (TRB), Tactical Night vision Company, https://tnvc.com/shop/tnvc-thermal-remote-battery-trb/ (last accessed Mar. 20, 2020).

* cited by examiner

STORAGE CONTAINER FOR MOUNTING ON FIREARMS

BACKGROUND

Technical Field

The present invention relates to storage containers designed to attach onto firearms and store equipment such as batteries, for example.

Background of the Invention

In the firearm industry, there is a desire to mount storage containers onto firearms. In particular, it is desirable to mount on a firearm a customizable storage container that is capable of storing a battery that can charge other devices and protecting the battery from water and other contaminants. Because space on a firearm rail is limited, it is also desirable to minimize the amount of rail space the storage container takes up on the firearm. Thus, there is a continuing need to mount storage containers onto firearms.

SUMMARY OF THE INVENTION

The present disclosure provides a method of mounting a storage container onto the rail of a firearm.

In some embodiments, the method may include providing a storage container having a container body that may include a top wall, a bottom wall, a container body height extending from the top wall to the bottom wall, a rear wall, an open front, a container body length extending from the rear wall to the open front and generally perpendicular to the container body height, a left side wall, a right side wall opposite the left side wall, a container body width extending from the right side wall to the left side wall and generally perpendicular to the container body length and the container body height, and a cavity formed in the container body by the top wall, the bottom wall, the rear wall, and the left and right side walls, and accessible from the open front. The storage container may further include a cap configured to be removably attached adjacent (i.e., at or near) to the open front of the container body.

The storage container may also include a receiver extending below the bottom wall of the container body and comprising a left rail, a right rail opposite the left rail, the left rail and right rail defining a slot having a slot length generally parallel to the container body length and a slot width generally parallel to the container body width. The storage container may also include a container rail extending from at least one of the left side wall, the right side wall, or the top wall of the container body. The container rail may include a rail length generally parallel to the slot length and a rail width generally parallel to the slot width.

The method may also include providing a firearm including a firearm rail. The method may further include removably attaching the storage container to the firearm by inserting the firearm rail into the slot of the storage container.

The storage container may also include a cap gasket disposed between the container body and the cap, the cap gasket creating a watertight seal so that water is unable to enter the cavity from outside of the cavity. Optionally, the cap of the storage container includes a cap groove extending about a perimeter of the cap and the cap gasket may be seated in the cap groove.

Optionally, the cap may include a rotatable knob. The cap may also include a front plate comprising a front plate opening. The cap may also include a rear plate comprising a rear plate recess, wherein the rotatable knob is rotatable clockwise or counterclockwise within the rear plate recess. Optionally, the rotatable knob may draw the cap rearwardly into the cavity of the container body when the rotatable knob is rotated. Optionally, the rotatable knob may include a knob rear flange located in the recess and a knob front end extending through the front plate opening in the front plate.

Optionally, the top wall of the container body includes a top groove adjacent to the open front, and the bottom wall may include a bottom groove adjacent to the open front. Optionally, the rotatable knob is rotatable from an unlocked position in which the rear flange arch-shaped left edge faces the recess arch-shaped left edge and the rear flange arch-shaped right edge faces the recess arch-shaped right edge, the flange width is generally parallel to the rear plate width, and the cap is removable from the open front to a locked position in which the rear flange arch-shaped left edge is located in one of the top groove and the bottom groove and the rear flange arch-shaped right edge is located in the other of the top groove and the bottom groove, the rear flange width is generally perpendicular to the rear plate width, and the cap is not removable from the open front.

The method may also include removing the cap from the open front, inserting a removable sleeve into the cavity of the container body and reattaching the cap to the open front. Optionally, the storage container may also include a sleeve gasket disposed between the container body and the removable sleeve. Optionally, the removable sleeve may include a sleeve groove extending about a perimeter of the removable sleeve and the sleeve gasket may be seated in the sleeve groove.

The method may also include removing the cap from the open front, inserting at least one battery through the open front and re-attaching the cap to the open front. The method may also include connecting the at least one battery to at least one external electrical device, for example, a flashlight or a mobile phone. The method may also include using a cord to connect the at least one battery to the at least one external electrical device. Additionally, the method may include connecting the at least one battery to at least one power source for charging the at least one battery.

In some embodiments, the cavity may also include a removable sleeve. Optionally, the removable sleeve is press fit into the cavity. Optionally, the removable sleeve may also include a flange. Optionally, the cavity may include a ledge. Optionally, the flange of the removable sleeve may confront the ledge of the cavity. The storage container may also include a sleeve gasket located between the flange of the removable sleeve and the ledge of the cavity. The flange of the removable sleeve may also include a sleeve groove extending around a perimeter of the flange. The sleeve gasket may be seated in the sleeve groove.

The method may further include sliding the firearm rail into the slot of the receiver generally parallel to the slot length. Preferably, the receiver is in the form of a clamp and includes at least one fastener extending from the left rail to the right rail. The method may further include adjusting the at least one fastener so as to narrow the slot width.

Optionally, the at least one battery may be substantially the same size and shape as the cavity in the container body. Optionally, the at least one battery may be press fit into the cavity. The storage container may also include a battery gasket located between the container body and the at least one battery. Optionally, the at least one battery includes a battery groove extending about a perimeter of the at least one battery with the battery gasket is seated in the battery groove. Optionally, the cavity may include a removable sleeve comprising a sleeve cavity comprising the at least one battery.

BRIEF DESCRIPTION OF THE DRAWINGS

in FIG. 1, the cap is in the unlocked position.

in FIGS. 1A-B, the cap is removed from the storage container and a cord connects a battery inside the storage container to various electrical devices, namely, a phone in FIG. 1A and a flashlight in FIG. 1B.

in FIG. 7, the container comprises two cylindrical batteries and a removable sleeve comprising the batteries.

in FIG. 7A, the container comprises a rectangular battery pack and a removable sleeve comprising the battery pack.

in FIG. 7B, the container comprises a battery pack and a battery gasket.

in FIG. 9, the cap is removed from the container.

DETAILED DESCRIPTION

Figure 1:
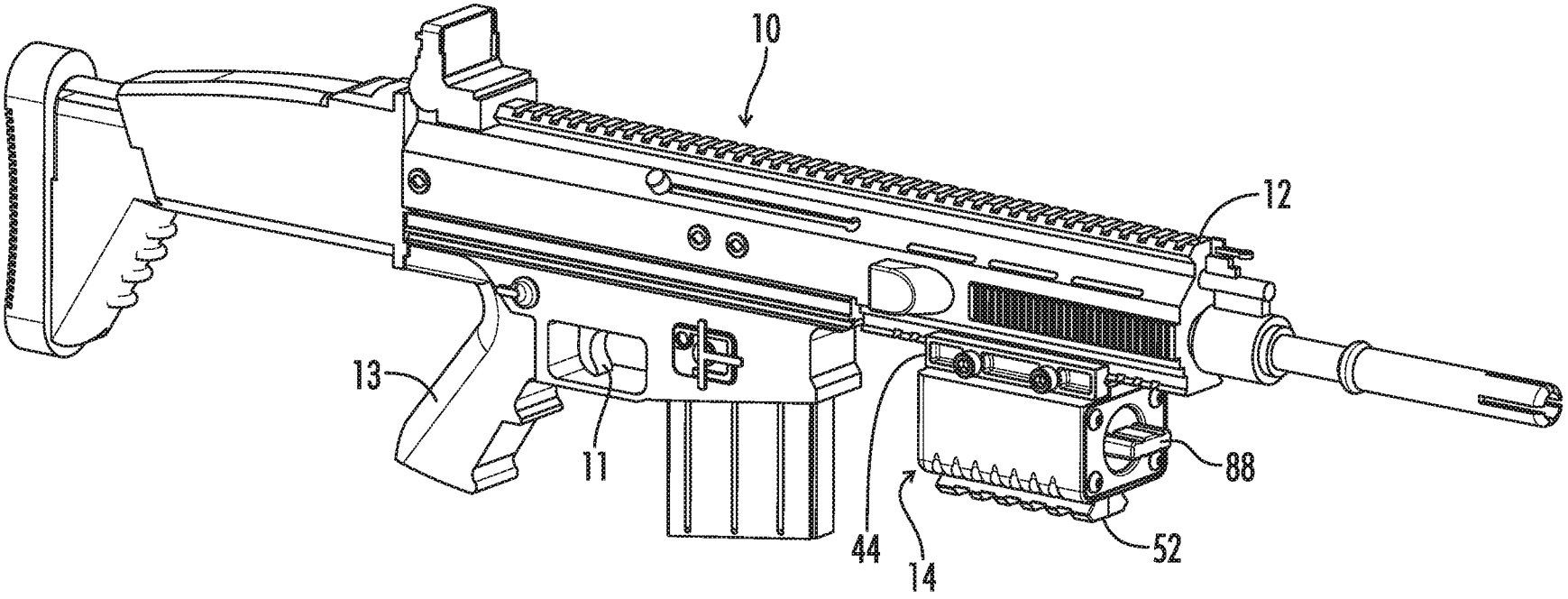
FIG. 1 illustrates a side perspective view of a container of one embodiment of the present invention attached to a Picatinny rail of a firearm.

With reference to FIGS. 1-9, the present invention provides a storage container 14 for mounting on the rail 12 of a firearm 10. Preferably, the firearm 10 includes a firearm trigger 11 and a firearm handle 13. In the drawings, not all reference numbers are included in each of the drawings for the sake of clarity. FIGS. 1-9 are drawn generally to scale, however, it will be appreciated that other dimensions are possible.

As shown in FIGS. 1-9, in some embodiments, the present disclosure provides a method of attaching a storage container 14 to a rail 12 of a firearm 10. The method may include providing a storage container 14 having a container body 16 that may include a top wall 18, a bottom wall 20, a container body height 22 extending from the top wall 18 to the bottom wall 20, a rear wall 24, an open front 26, a container body length 28 extending from the rear wall 24 to the open front 26 and generally perpendicular to the container body height 22, a left side wall 30, a right side wall 32 opposite the left side wall 30, a container body width 34 extending from the right side wall 32 to the left side wall 30 and generally perpendicular to the container body length 28 and the container body height 22, and a cavity 36 formed in the container body 16 by the top wall 18, the bottom wall 20, the rear wall 24, and the left and right side walls 30 and 32, and accessible from the open front 26. Optionally, the bottom wall 20 is configured to face a firearm rail 12. Although words such as front, rear, left, right, top and bottom are used herein, it will be understood that different orientations of use are possible; for example, the storage container 14 will be inverted if the storage container 14 is attached to the top rail 12 of the firearm 10 of FIG. 1B, instead of the bottom rail 12.

The storage container 14 may further include a cap 37 configured to be removably attached adjacent to the open front 26 of the container body 16.

The storage container 14 may also include a receiver 40 extending below the bottom wall 20 of the container body 16 and comprising a left rail 42, a right rail 44 opposite the left rail 42, the left rail 42 and right rail 44 defining a slot 46 having a slot length 48 generally parallel to the container body length 28 and a slot width 50 generally parallel to the container body width 34. Optionally, the left and right rails 42 and 44 may be fixed in which case the slot width 50 is fixed. Alternatively, the left and right rails 42 or 44 may be moveable/adjustable in which case the slot width 50 is adjustable using adjustment fastener 82, as described in greater detail below. The storage container 14 may also include a container rail 52 extending from at least one of the left side wall 30, the right side wall 32, or the top wall 18 of the container body 16, the container rail 52 having a rail length 54 generally parallel to the slot length 48 and a rail width 56 generally parallel to the slot width 50.

The method may also include providing a firearm 10 including a firearm rail 12. Optionally, the firearm rail 12 may be located on the top, sides, or bottom of the firearm 10 or any other suitable location on the firearm 10. The method may further include removably attaching the storage container 14 to the firearm 10 by inserting the firearm rail 12 into the slot 46 of the storage container 14.

The storage container 14 may further include a cap gasket 38 disposed between the container body 16 and the cap 37, the cap gasket 38 creating a watertight seal so that water is unable to enter the cavity 36 from outside of the cavity 36. Optionally, the cap 37 of the provided storage container 14 includes a cap groove 39 located between the forward end and the rear end of the cap 37 and extending about a perimeter of the cap 37 and the cap gasket 38 is seated in the cap groove 39.

Optionally, the cap 37 may also include a rotatable knob 88. The cap 37 may also include a front plate 90 comprising a front plate opening 92. The cap may also include a rear plate 94 that may be attached to the front plate 90 using one or more fasteners 93 and may include a rear plate recess 95, a rear plate top 150, a rear plate bottom 152, a rear plate height 154 extending from the rear plate top 150 to the rear plate bottom 152 and substantially equal to the container body height 22 at the open front 26, a rear plate left side 156, a rear plate right side 158 opposite the rear plate left side 156, a rear plate width 160 extending from the rear plate left side 156 to the rear plate right side 158 and substantially equal to the container body width 34 at the open front 26. Optionally, the recess 95 comprises a recess arch-shaped left edge 162, a recess arch-shaped right edge 164, a maximum recess width 166 that may be located approximately halfway between the rear plate top edge 150 and rear plate bottom edge 152 and extending from the recess arch-shaped left edge 162 to the recess arch-shaped right edge 164. Optionally, the maximum recess width 166 less than the rear plate width 160. Optionally, the rear plate 94 includes a top notch 140, a bottom notch 142, the top and bottom notches 140 and 142 located between the recess arch-shaped left edge 162 and recess arch-shaped right edge 164. Optionally, the rotatable knob 88 is rotatable clockwise or counterclockwise within the rear plate recess 95. Optionally, the rotatable knob 88 may draw the cap 37 rearwardly into the cavity 36 of the container body 16 when the rotatable knob 88 is rotated.

Optionally, the rotatable knob 88 may include a knob rear flange 96 located in the recess 95 and a knob front end 98 extending through the front plate opening 92 in the front plate 90, the rear flange 96 of the rotatable knob 88 comprising a substantially flat rear surface 168, a bottom edge 100 comprising a left bottom edge endpoint 102 and a right bottom edge endpoint 104, a bottom edge width 105 extending from the left bottom edge endpoint 102 to the right bottom edge endpoint 104, a top edge 106 extending generally parallel to the bottom edge 100. Optionally, the top edge 106 comprises a left top edge endpoint 108 and a right top edge endpoint 110, a top edge width 170 extending from the left top edge endpoint 108 to the right top edge endpoint 110. Optionally, the top edge width 170 is substantially equal to the bottom edge width 105. Optionally, the rear flange 96 includes a rear flange height 112 extending from the bottom edge 100 to the top edge 106 and generally perpendicular to the top edge 106 and bottom edge 100. Optionally, the rear flange height 112 is less than or equal to the rear plate height 154. Optionally, the rear flange 96 further comprises a rear flange arch-shaped left edge 114 extending between the left top edge endpoint 108 and the left bottom edge endpoint, a rear flange arch-shaped right edge 116 opposite the rear flange arch-shaped left edge 114 and extending between the right top edge endpoint 110 and the right bottom edge endpoint 104, a maximum rear flange width 118 that may be located approximately halfway between the top edge 106 and bottom edge 100 and extending between the rear flange arch-shaped left edge 114 and the rear flange arch-shaped right edge 116 (more particularly, between the apices of the rear flange arch-shaped left edge 114 and the rear flange arch-shaped right edge 116) and generally perpendicular to the rear flange height 112. Optionally, the maximum flange width 118 is greater than the rear plate height 154.

Figure 9:
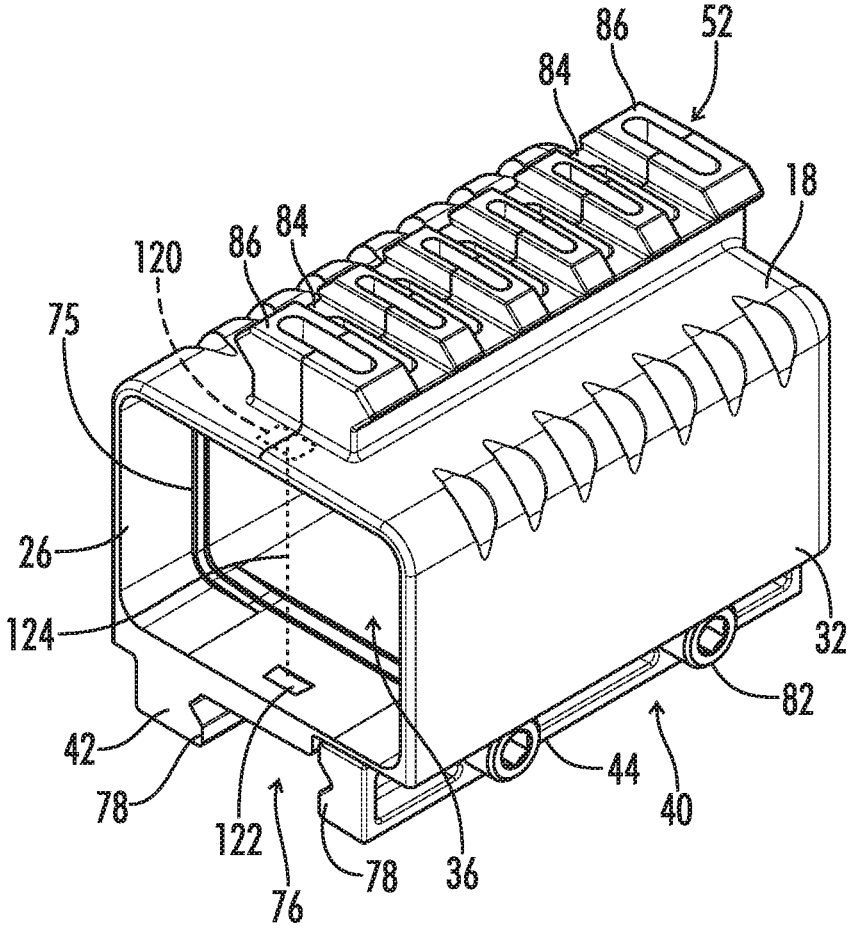
FIG. 9 is a top front right perspective view of the container of FIG. 2.

As seen in FIG. 9 the top wall 18 of the container body 16 may include a top groove 120 adjacent to the open front 26, and the bottom wall 20 may include a bottom groove 122 adjacent to the open front 26. Optionally, as indicated by the rotational arrows shown in FIG. 4, the rotatable knob 88 is rotatable clockwise and/or counter-clockwise from an unlocked position in which the rear flange arch-shaped left edge 114 faces the recess arch-shaped left edge 162 and the rear flange arch-shaped right edge 116 faces the recess arch-shaped right edge 164, the flange width 118 is generally parallel to the rear plate width 160, and the cap 37 is removable from the open front 26 to a locked position in which the rear flange arch-shaped left edge 114 is located in one of the top groove 120 and the bottom groove 122 and the rear flange arch-shaped right edge 116 is located in the other of the top groove 120 and the bottom groove 122, the rear flange width 118 is generally perpendicular to the rear plate width 160, and the cap 37 is not removable from the open front 26.

Figure 8A:
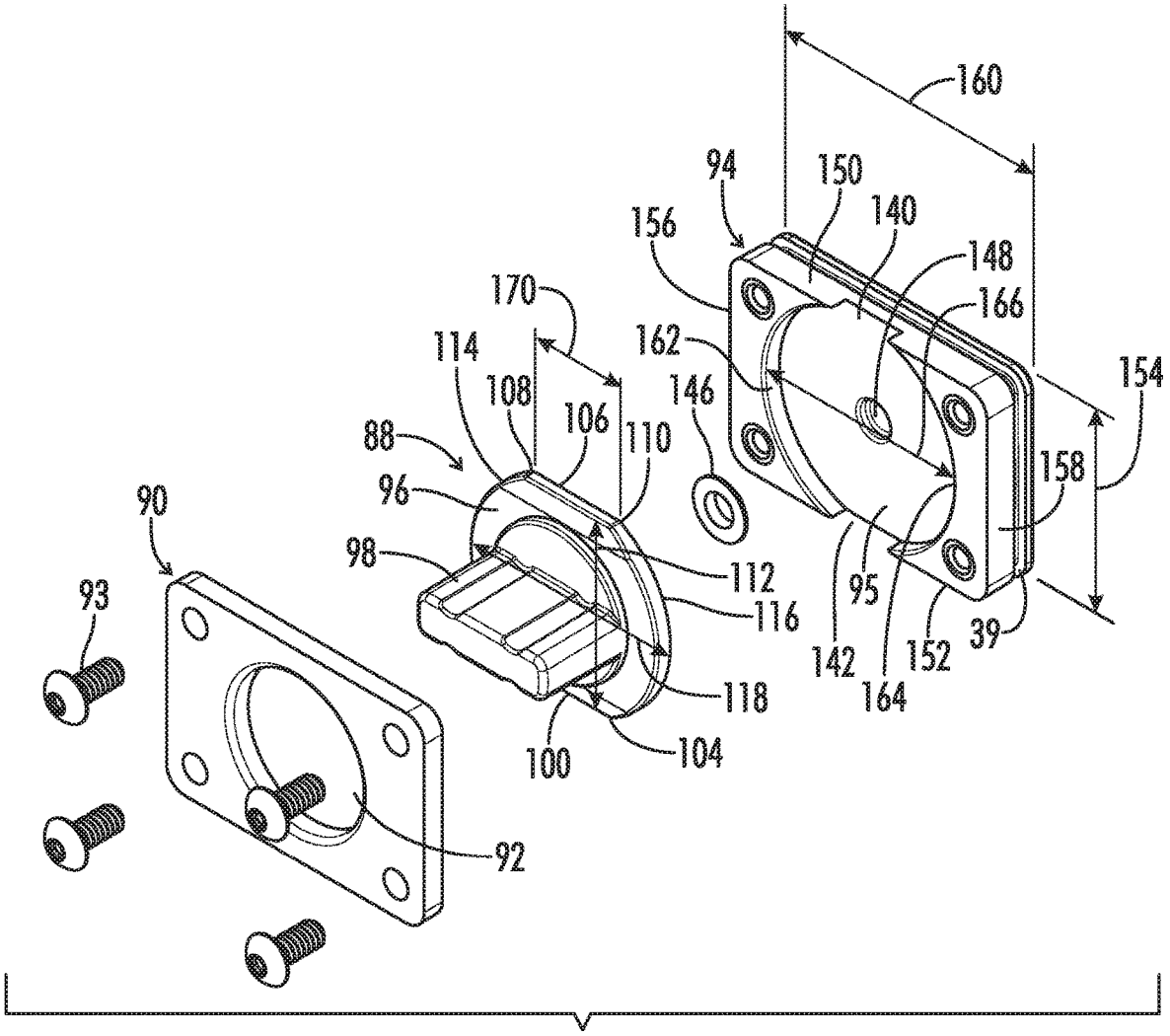
FIG. 8A is a top front right exploded perspective view of the cap of the container of FIG. 2.
Figure 8B:
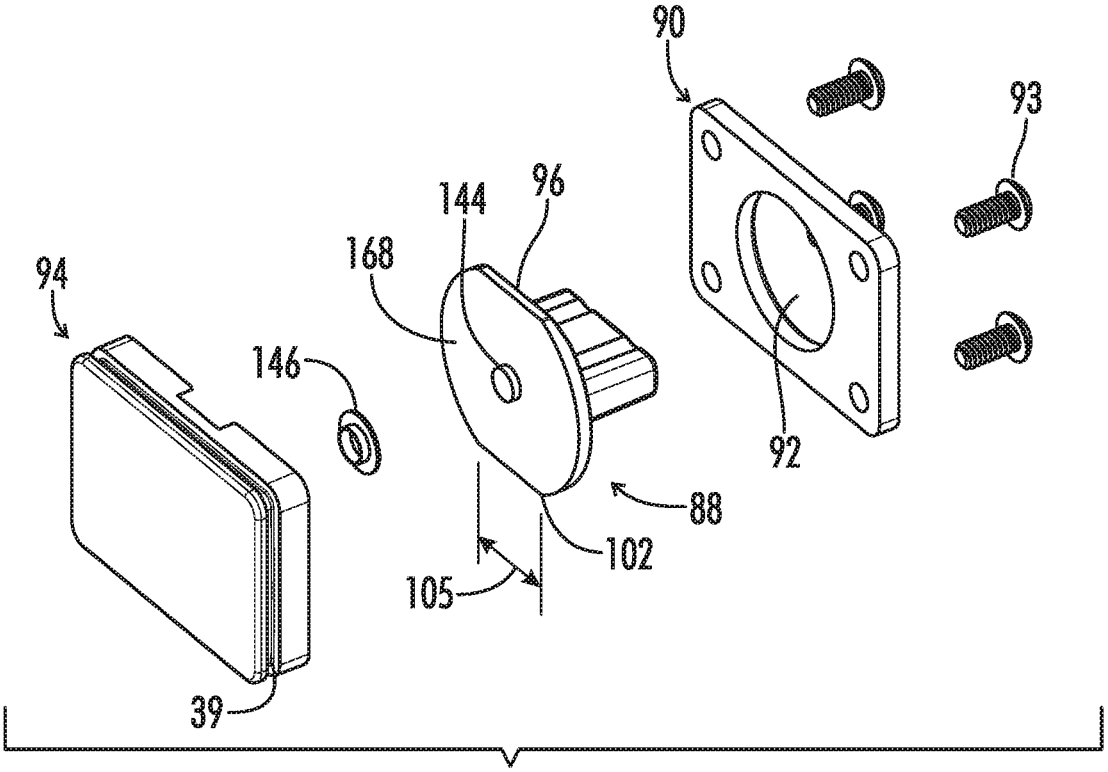
FIG. 8B is a top rear left exploded perspective view of the container of FIG. 2.

As seen in FIGS. 8A-8B, in some embodiments, the rear plate 94 may include a generally circular hole 148. The rotatable knob 88 may also include a stem 144 extending rearwardly from the rear flange 96. Optionally, the stem 144 is configured to rotate within the generally circular hole 148 as the cap moves between the locked and unlocked positions. The cap 37 may further include a washer 146. Optionally, the washer 146 is configured to fit around the stem 144 and is disposed between the rear plate 94 and the rear flange 96. Optionally, the front end 98 of the knob 88 is oriented generally parallel to the container body width 34 in the unlocked position and generally perpendicular to the container body width 34 in the locked position.

The method may also include removing the cap 37 from the open front 26, inserting a removable sleeve 58 into the cavity 36 of the container body 16 and reattaching the cap 37 to the open front 26. Optionally, the storage container 14 may also include a sleeve gasket 72 disposed between the container body 16 and the removable sleeve 58. Optionally, the removable sleeve 58 may include a sleeve groove 74 extending about a perimeter of the removable sleeve 58 and the sleeve gasket 72 may be seated in the sleeve groove 74.

Figure 1A:
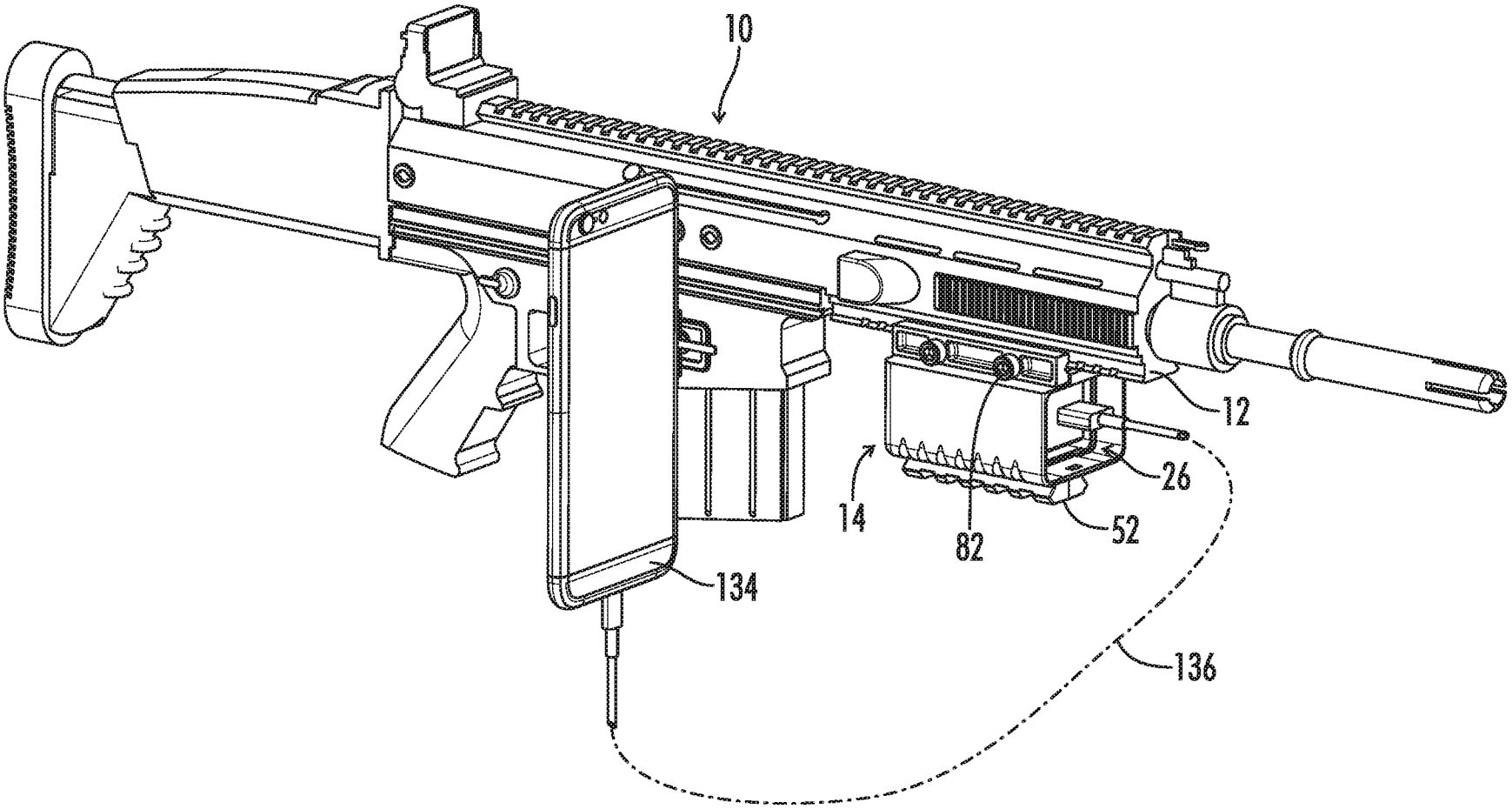
FIGS. 1A-B illustrate side perspective views of the container and firearm of FIG. 1.
Figure 1B:
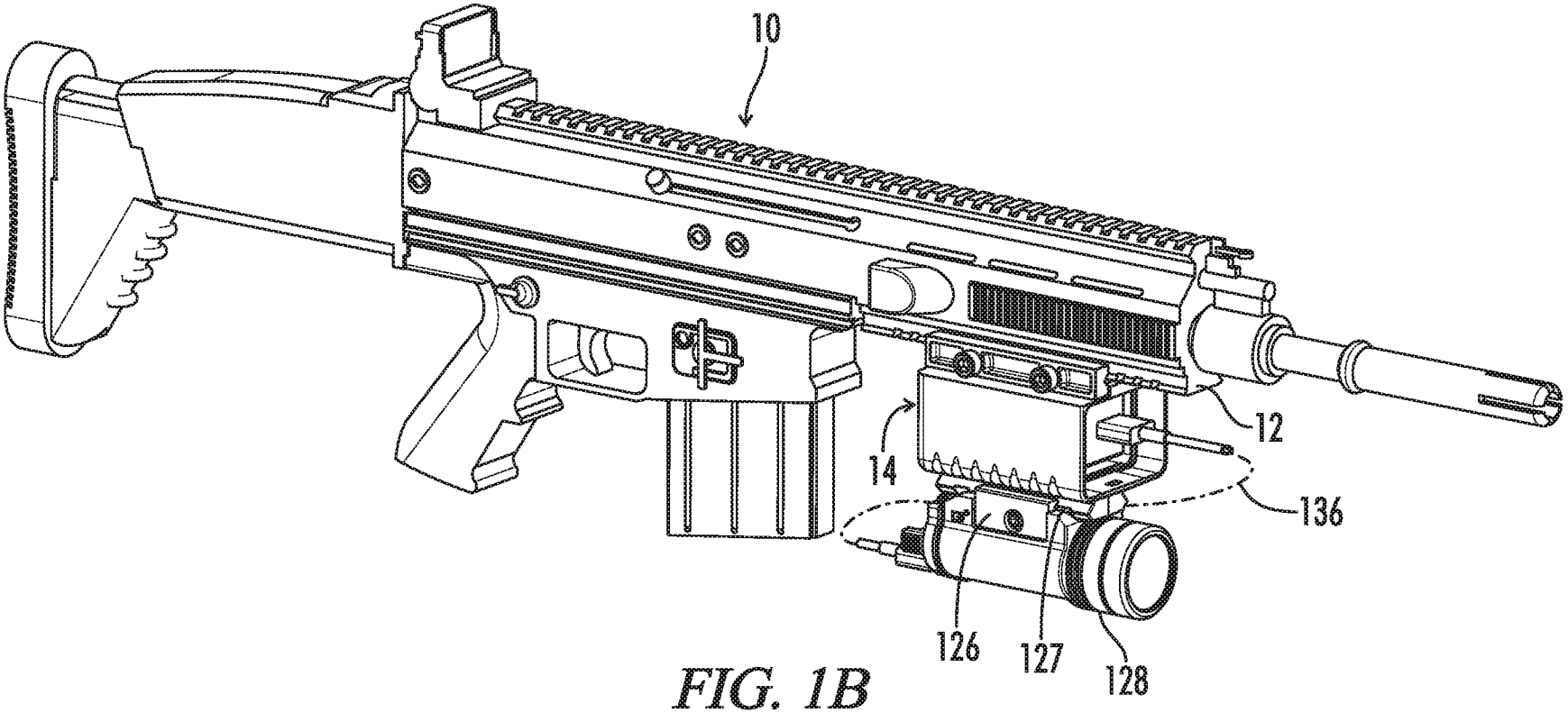
Figure 2:
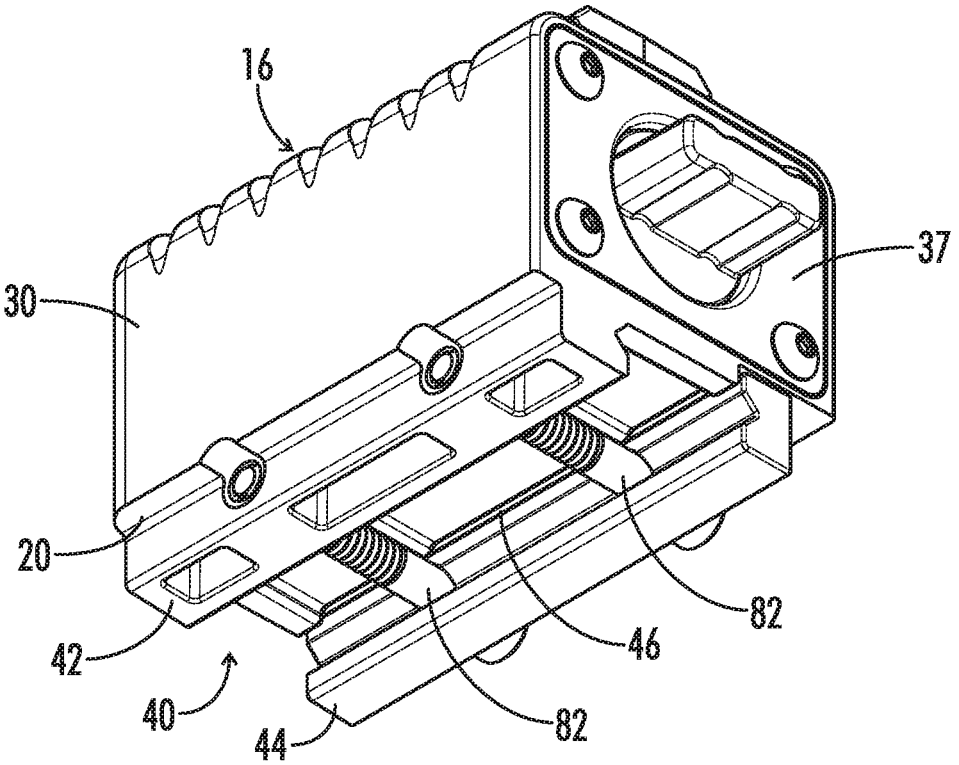
FIG. 2 is a bottom front left perspective view of the container of FIG. 1 with the cap in the unlocked position.
Figure 3:
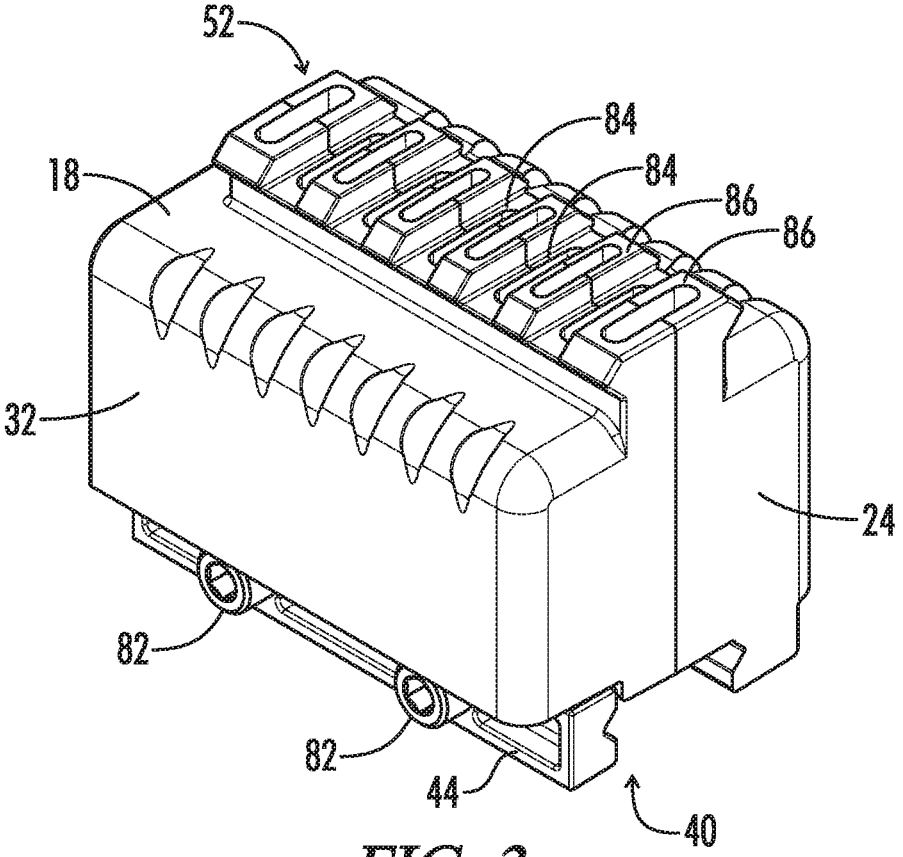
FIG. 3 is a top rear right perspective view of the container of FIG. 2.
Figure 4:
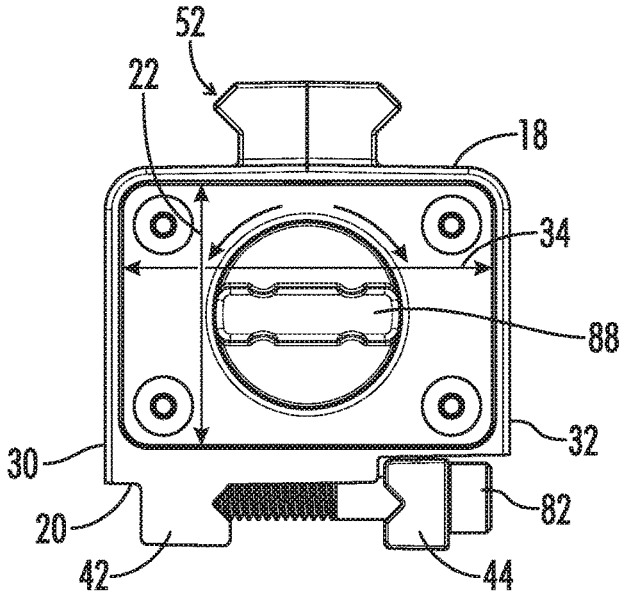
FIG. 4 is a front elevation view of the container of FIG. 2.
Figure 5:
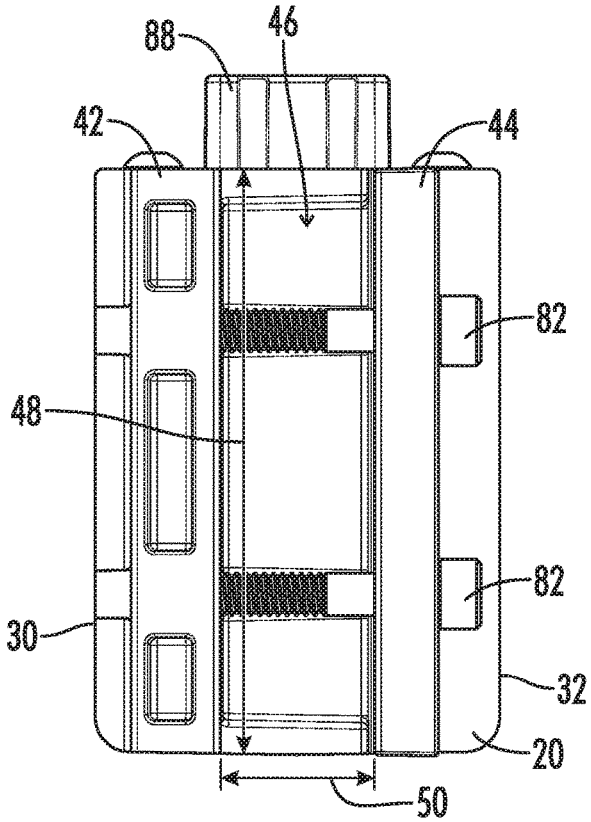
FIG. 5 is a bottom plan view of the container of FIG. 2.
Figure 6:
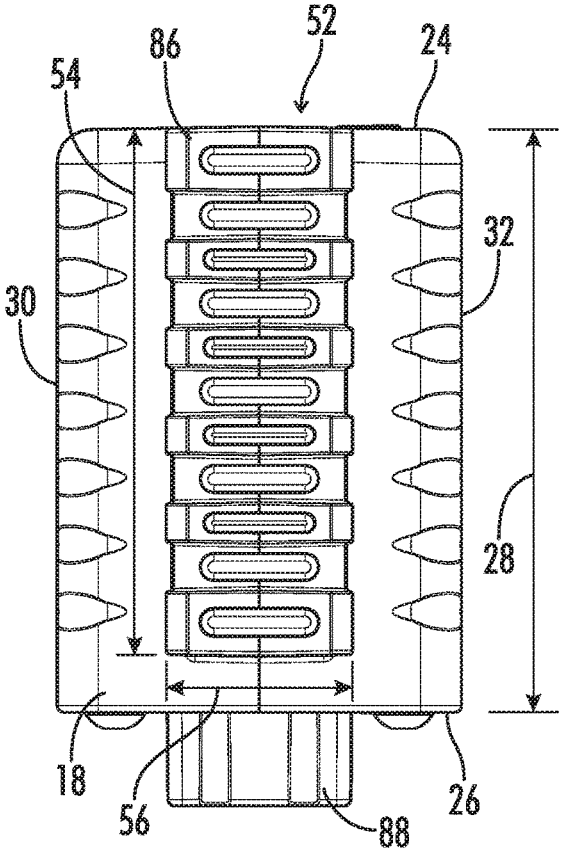
FIG. 6 is a top plan view of the container of FIG. 2.
Figure 7:
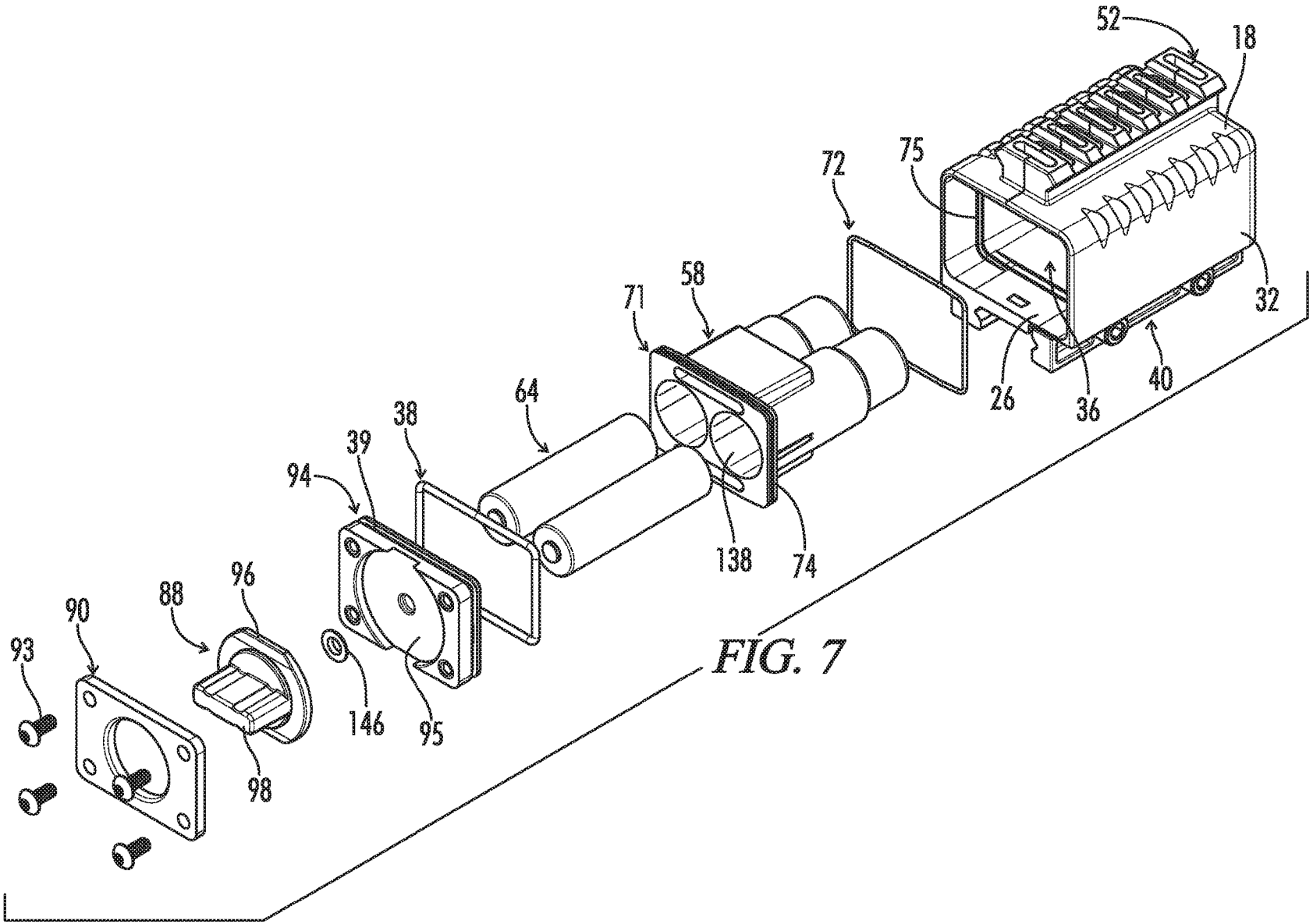
FIG. 7 is a top front right exploded perspective view of the container of FIG. 2.
Figure 7A:
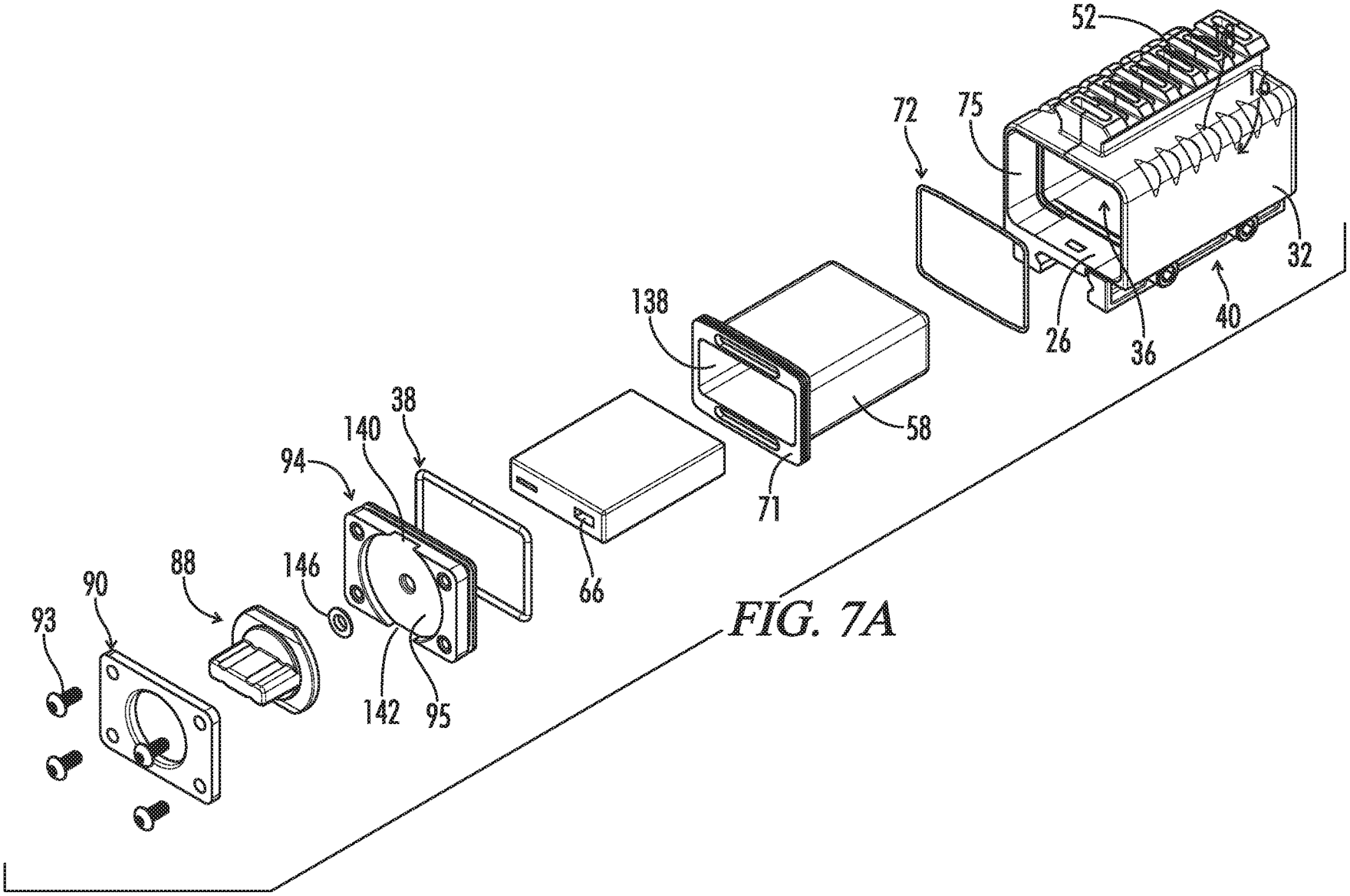
FIG. 7A is a top front right exploded perspective view of the container of FIG. 2.
Figure 7B:
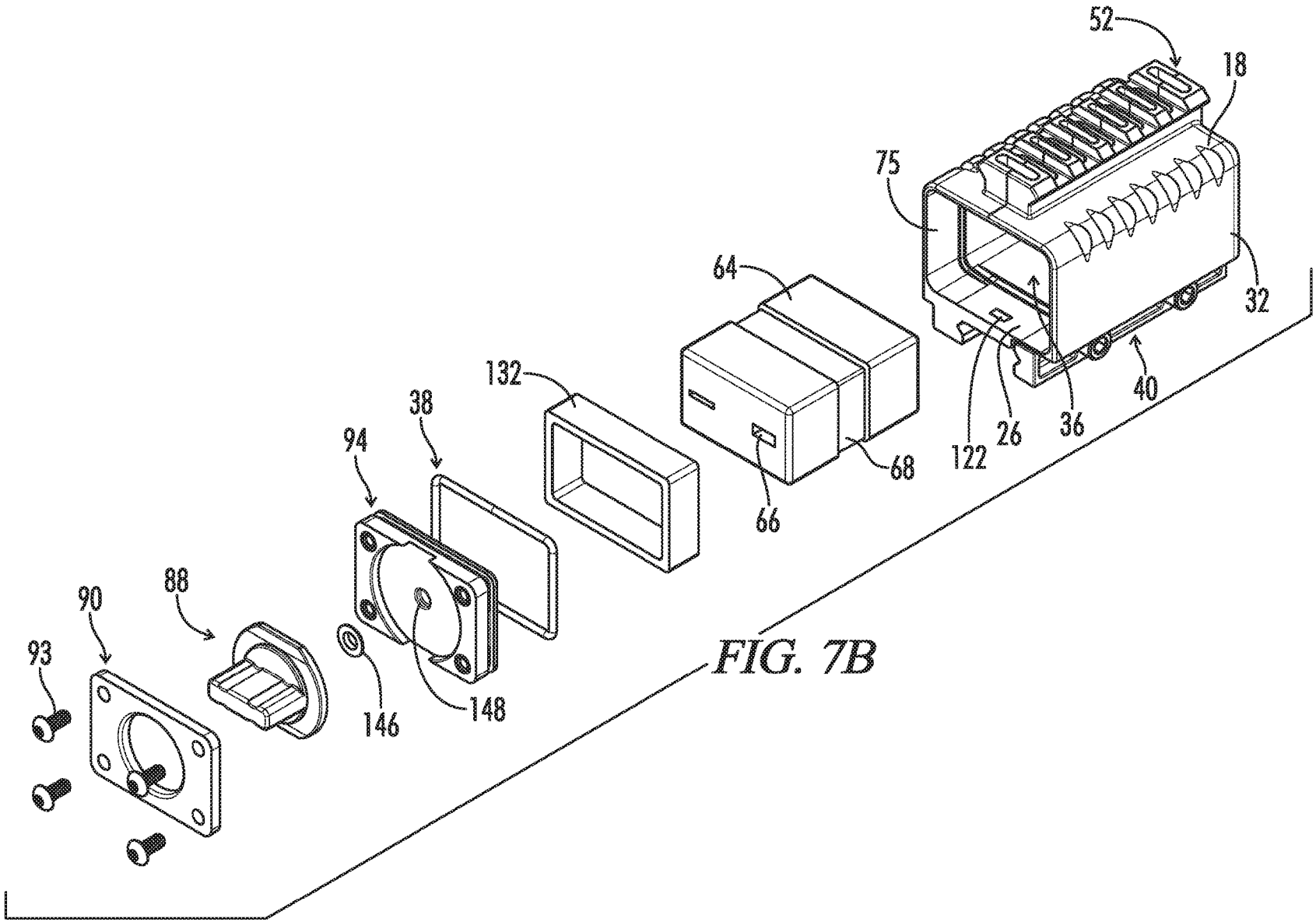
FIG. 7B is a top front right exploded perspective view of the container of FIG. 2.

The method may also include removing the cap 37 from the open front 26, inserting at least one battery 64 through the open front 26 and re-attaching the cap 37 to the open front 26. The at least one battery 64 may be a commercially available battery, for example, a AA battery as shown in FIG. 7, or the at least one battery 64 may be may be a battery pack as shown in FIGS. 7A-7B, for example. The method may also include connecting the at least one battery 64 to at least one external electrical device. Optionally, the at least one battery 64 may include a battery port 66 through which the at least one external device 126 may connect to the at least one battery 64. As seen in FIGS. 1A-1B, the at least one external electrical device may be, for example, a flashlight 128 or a mobile phone 134. If included, the flashlight 128 may be attached to the firearm 10 using a flashlight holder 126. The method may also include using a cord 136 to connect the at least one battery 64 to the at least one external electrical device. Additionally, the method may include connecting the at least one battery 64 to at least one power source (not shown) for charging the at least one battery 64.

Optionally, the firearm rail 12 and the container rail 52 are generally the same shape. Optionally, the firearm rail 12 and the container rail 52 are Picatinny rails or Weaver rails.

As seen in FIGS. 7-7A, in some embodiments, the cavity 36 may also include a removable sleeve 58. Optionally, the removable sleeve 58 is press fit into the cavity 36. The removable sleeve 58 may also include a flange 71. The cavity 36 may include a ledge 75. The flange 71 of the removable sleeve 58 may confront the ledge 75 of the cavity 36. The storage container 14 may also include a sleeve gasket 72 located between the flange 75 of the removable sleeve 58 and the ledge 75 of the cavity 36. The flange 75 of the removable sleeve 58 may also include a sleeve groove 74 extending around a perimeter of the flange 75. The sleeve gasket 72 may be seated in the sleeve groove 74.

In some embodiments, each of the left rail 42 and right rail 44 of the receiver 40 may include a rail bottom 76 comprising a lip 78 to prevent the firearm rail 12 from falling between the rail bottom 76 of the left rail 42 and the rail bottom 76 of the right rail 44. The method may further include, in step c), sliding the firearm rail 12 into the slot 46 of the receiver 40 generally parallel to the slot length 48. Optionally, the receiver 40 is in the form of a clamp and includes at least one adjustment fastener 82 extending from the left rail 42 to the right rail 44. The method may further include adjusting the at least one adjustment fastener 82 after step b) so as to narrow the slot width 50.

Optionally, the cavity 36 is generally rectangular in shape. The container rail 52 may also include a plurality of raised sections 86 separated by a plurality of channels 84. Optionally, the plurality of channels 84 and plurality of raised sections 86 extend generally parallel to the rail width 56.

As seen in FIG. 1B, in some embodiments, the method may further include attaching an external electrical device to the storage container 14 by inserting the container rail 52 into the external device slot 127.

Optionally, the at least one battery 64 may be substantially the same size and shape as the cavity 36 in the container body 16. Optionally, the at least one battery is press fit into the cavity 36. The storage container 14 may also include a battery gasket 132 located between the container body 16 and the at least one battery 64. Without being bound by any particular theory, a function of the battery gasket 132 may be to make the at least one battery 64 press fit within the cavity 36. Another function of the battery gasket 132 may be to keep contaminates, such as water, away from the at least one battery 64.

The at least one battery 64 may also include a battery groove 68 extending about a perimeter of the at least one battery 64 and the battery gasket 132 may be seated in the battery groove 68. Optionally, the cavity 36 may include a removable sleeve 58 comprising a sleeve cavity 138 comprising the at least one battery 64.

| Part List | |
|---|---|
| firearm | 10 |
| firearm trigger | 11 |
| firearm rail | 12 |
| firearm handle | 13 |
| storage container | 14 |
| container body | 16 |
| top wall | 18 |
| bottom wall | 20 |
| container body height | 22 |
| rear wall | 24 |
| open front | 26 |
| container body length | 28 |
| left side wall | 30 |
| right side wall | 32 |
| container body width | 34 |
| cavity | 36 |
| cap | 37 |
| cap gasket | 38 |
| cap groove | 39 |
| receiver | 40 |
| left rail | 42 |
| right rail | 44 |
| slot | 46 |
| slot length | 48 |
| slot width | 50 |
| container rail | 52 |
| rail length | 54 |
| rail width | 56 |
| removable sleeve | 58 |
| at least one battery | 64 |
| battery port | 66 |
| battery groove | 68 |
| sleeve flange | 71 |
| sleeve gasket | 72 |
| sleeve groove | 74 |
| ledge | 75 |
| rail bottom | 76 |
| lip | 78 |
| at least one adjustment fastener | 82 |
| container rail channels | 84 |
| container rail raised sections | 86 |
| rotatable knob | 88 |
| front plate | 90 |
| front plate opening | 92 |
| front plate fastener | 93 |
| rear plate | 94 |
| rear plate recess | 95 |
| knob rear flange | 96 |
| knob front end | 98 |

-continued

| Part List | |
|---|---|
| knob bottom edge | 100 |
| left bottom edge endpoint | 102 |
| right bottom edge endpoint | 104 |
| knob bottom edge width | 105 |
| knob top edge | 106 |
| left top edge endpoint | 108 |
| right top edge endpoint | 110 |
| rear flange height | 112 |
| rear flange arch-shaped left edge | 114 |
| rear flange arch-shaped right edge | 116 |
| maximum flange width | 118 |
| top groove | 120 |
| bottom groove | 122 |
| distance between top and bottom grooves | 124 |
| flashlight holder | 126 |
| power source | Not shown |
| external device slot | 127 |
| flashlight | 128 |
| battery gasket | 132 |
| mobile phone | 134 |
| cord | 136 |
| sleeve cavity | 138 |
| top notch | 140 |
| bottom notch | 142 |
| stem | 144 |
| washer | 146 |
| generally circular rear plate hole | 148 |
| rear plate top | 150 |
| rear plate bottom | 152 |
| rear plate height | 154 |
| rear plate left side | 156 |
| rear plate right side | 158 |
| rear plate width | 160 |
| recess arch-shaped left edge | 162 |
| recess arch-shaped right edge | 164 |
| maximum recess width | 166 |
| knob rear surface | 168 |
| top edge width | 170 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A method of attaching a storage container to a rail of a firearm comprising the steps of:

a) providing a storage container comprising:

i) a container body comprising a top wall, a bottom wall, a container body height extending from the top wall to the bottom wall, a rear wall, an open front, a container body length extending from the rear wall to the open front and generally perpendicular to the container body height, a left side wall, a right side wall opposite the left side wall, a container body width extending from the right side wall to the left side wall and generally perpendicular to the container body length and the container body height, and a cavity formed in the container body by the top wall, the bottom wall, the rear wall, and the left and right side walls and accessible from the open front;

ii) a cap configured to be removably attached adjacent to the open front of the container body;

iii) a receiver extending below the bottom wall of the container body and comprising a left rail, a right rail opposite the left rail, the left rail and right rail defining a slot having a slot length generally parallel to the container body length and a slot width generally parallel to the container body width; and iv) a container rail extending from at least one of the left side wall, the right side wall, or the top wall of the container body, the container rail having a rail length generally parallel to the slot length and a rail width generally parallel to the slot width; and b) providing a firearm comprising a firearm rail;

c) removably attaching the storage container to the firearm by inserting the firearm rail into the slot of the storage container.

2. The method of claim 1 wherein the cap is attached to the container body adjacent to the open front, wherein the storage container further comprises a cap gasket disposed between the container body and the cap, the cap gasket creating a watertight seal so that water is unable to enter the cavity from outside of the cavity.

3. The method of claim 2 wherein the cap comprises a cap forward end, a cap rear end, and a cap groove located between the cap forward end and the cap rear end and extending about a perimeter of the cap and the cap gasket is seated in the cap groove.

4. The method of claim 1 wherein the cap comprises a rotatable knob, a front plate and a rear plate, wherein the front plate comprises a front plate opening and wherein the rear plate comprises a rear plate recess, a rear plate top, a rear plate bottom, a rear plate height extending from the rear plate top to the rear plate bottom and generally parallel to the container body height, a rear plate left side, a rear plate right side opposite the rear plate left side, a rear plate width extending from the rear plate left side to the rear plate right side and generally parallel to the container body width, wherein the recess comprises a recess arch-shaped left edge, a recess arch-shaped right edge, a maximum recess width located approximately halfway between the rear plate top edge and rear plate bottom edge and extending from the recess arch-shaped left edge to the recess arch-shaped right edge, the recess width less than the rear plate width, a top notch, a bottom notch, the top and bottom notches located between the recess arch-shaped left edge and recess arch-shaped right edge, and further wherein the rotatable knob is rotatable clockwise or counterclockwise within the recess.

5. The method of claim 4 wherein the rotatable knob comprises a knob rear flange located in the recess and a knob front end extending through the opening in the front plate, the rear flange of the rotatable knob comprising a substantially flat rear surface, a bottom edge comprising a left bottom edge endpoint and a right bottom edge endpoint, a bottom edge width extending from the left bottom edge endpoint to the right bottom edge endpoint, a top edge extending generally parallel to the bottom edge, the top edge comprising a left top edge endpoint and a right top edge endpoint, a top edge width extending from the left top edge endpoint to the right top edge endpoint, wherein the top edge width is substantially equal to the bottom edge width, a rear flange height extending from the bottom edge to the top edge and generally perpendicular to the top edge and bottom edge, wherein the rear flange height is less than or equal to the rear plate height, wherein the rear flange further comprises a rear flange arch-shaped left edge extending between the left top edge endpoint and the left bottom edge endpoint, a rear flange arch-shaped right edge opposite the rear flange arch-shaped left edge and extending between the right top edge endpoint and the right bottom edge endpoint, a maximum rear flange width located approximately halfway between the top edge and bottom edge and extending between the rear flange arch-shaped left edge and the rear flange arch-shaped right edge and generally perpendicular to the rear flange height, and further wherein the maximum rear flange width is greater than the rear plate height.

6. The method of claim 5 wherein the top wall comprises a top groove adjacent to the open front and the bottom wall comprises a bottom groove adjacent to the open front, and further wherein the rotatable knob is rotatable from:

a) an unlocked position in which:

i) the rear flange arch-shaped left edge faces the recess arch-shaped left edge and the rear flange arch-shaped right edge faces the recess arch-shaped right edge;

ii) the rear flange width is generally parallel to the rear plate width; and iii) the cap is removable from the open front;

b) to a locked position in which:

i) the rear flange arch-shaped left edge is located in one of the top groove and the bottom groove and the rear flange arch-shaped right edge is located in the other of the top groove and the bottom groove;

ii) the rear flange width is generally perpendicular to the rear plate width; and iii) the cap is not removable from the open front.

7. The method of claim 6 wherein the rear plate further comprises a generally circular hole, wherein the rotatable knob further comprises a stem extending rearwardly from the rear flange, the stem configured to rotate within the generally circular hole as the cap moves between the locked and unlocked positions.

8. The method of claim 1 wherein the method further comprises removing the cap from the open front, inserting a removable sleeve into the cavity of the container body and re-attaching the cap to the open front.

9. The method of claim 8 wherein the storage container further comprises a sleeve gasket disposed between the container body and the removable sleeve, wherein the removable sleeve comprises a sleeve groove extending about a perimeter of the removable sleeve and further wherein the sleeve gasket is seated in the sleeve groove.

10. The method of claim 9 wherein the removable sleeve comprises a flange and the cavity comprises a ledge, wherein the flange confronts the ledge and further wherein the sleeve gasket is located between the flange and the ledge.

11. The method of claim 9 wherein the removable sleeve comprises a sleeve cavity comprising at least one battery comprising a battery port and the method further comprises connecting the at least one battery port to an external device using a cord.

12. The method of claim 1 wherein the method further comprises removing the cap from the open front, inserting at least one battery through the open front and re-attaching the cap to the open front.

13. The method of claim 1 wherein the firearm rail and the container rail are Picatinny rails or Weaver rails.

14. The method of claim 1 wherein the receiver is in the form of a clamp further comprising at least one fastener extending from the left rail to the right rail and further wherein step c) comprises adjusting the at least one fastener after inserting the firearm rail into the slot of the storage container so as to narrow the slot width.

15. A method of attaching a container to a rail of a firearm comprising the steps of:

a) providing a storage container comprising:

i) a container body comprising a top wall, a bottom wall, a container body height extending from the top wall to the bottom wall, a rear wall, an open front, a container body length extending from the rear wall to the open front and generally perpendicular to the container body height, a left side wall, a right side wall opposite the left side wall, a container body width extending from the right side wall to the left side wall and generally perpendicular to the container body length and the container body height, and a cavity formed in the container body by the top wall, the bottom wall, the rear wall, and the left and right side walls and accessible by the open front;

ii) a cap configured to be removably attached adjacent to the open front of the container body;

iii) at least one battery disposed inside the cavity of the container body; and iv) a receiver extending below the bottom wall of the container body and configured to attach the storage container to a rail of a firearm;

b) providing a firearm comprising a firearm rail; and c) removably attaching the storage container to the firearm rail by inserting the firearm rail into the slot of the storage container.

16. The method of claim 15 wherein the cap is attached to the container body adjacent to the open front, wherein the storage container further comprises a cap gasket disposed between the container body and the cap, the cap gasket creating a watertight seal so that water is unable to enter the cavity from outside of the cavity.

17. The method of claim 15 wherein the cap comprises a rotatable knob, wherein the cap comprises a front plate and a rear plate, wherein the front plate comprises a front plate opening and wherein the rear plate comprises a rear plate recess, a rear plate top, a rear plate bottom, a rear plate height extending from the rear plate top to the rear plate bottom and generally parallel to the container body height, a rear plate left side, a rear plate right side opposite the rear plate left side, a rear plate width extending from the rear plate left side to the rear plate right side and generally parallel to the container body width, wherein the recess comprises a recess arch-shaped left edge, a recess arch-shaped right edge, a maximum recess width located approximately halfway between the rear plate top edge and rear plate bottom edge and extending from the recess arch-shaped left edge to the recess arch-shaped right edge, the recess width less than the rear plate width, a top notch, a bottom notch, the top and bottom notches located between the recess arch-shaped left edge and recess arch-shaped right edge, and further wherein the rotatable knob is rotatable clockwise or counterclockwise within the recess.

18. The method of claim 17 wherein the rotatable knob comprises a rear flange located in the recess and a knob front end extending through the opening in the front plate, the rear flange of the rotatable knob comprising a substantially flat rear surface, a bottom edge comprising a left bottom edge endpoint and a right bottom edge endpoint, a bottom edge width extending from the left bottom edge endpoint to the right bottom edge endpoint, a top edge extending generally parallel to the bottom edge, the top edge comprising a left top edge endpoint and a right top edge endpoint, a top edge width extending from the left top edge endpoint to the right top edge endpoint, wherein the top edge width is substantially equal to the bottom edge width, a rear flange height extending from the bottom edge to the top edge and generally perpendicular to the top edge and bottom edge, wherein the rear flange height is less than or equal to the rear plate height, wherein the rear flange further comprises a rear flange arch-shaped left edge extending between the left top edge endpoint and the left bottom edge endpoint, a rear flange arch-shaped right edge opposite the rear flange arch-shaped left edge and extending between the right top edge endpoint and the right bottom edge endpoint, a maximum rear flange width located approximately halfway between the top edge and bottom edge and extending between the rear flange arch-shaped left edge and the rear flange arch-shaped right edge and generally perpendicular to the rear flange height, and further wherein the maximum rear flange width is greater than the rear plate height.

19. The method of claim 18 wherein the top wall comprises a top groove adjacent to the open front and the bottom wall comprises a bottom groove adjacent to the open front, and further wherein the rotatable knob is rotatable from:

a) an unlocked position in which:

i) the rear flange arch-shaped left edge faces the recess arch-shaped left edge and the rear flange arch-shaped right edge faces the recess arch-shaped right edge;

ii) the rear flange width is generally parallel to the rear plate width; and iii) the cap is removable from the open front;

b) to a locked position in which:

i) the rear flange arch-shaped left edge is located in one of the top groove and the bottom groove and the rear flange arch-shaped right edge is located in the other of the top groove and the bottom groove;

ii) the rear flange width is generally perpendicular to the rear plate width; and iii) the cap is not removable from the open front.

20. The method of claim 15 further wherein the storage container further comprises a battery gasket located between the container body and the at least one battery.

21. The method of claim of claim 20 wherein the at least one battery further comprises a battery groove extending about a perimeter of the at least one battery and the battery gasket is seated in the battery groove.

22. The method of claim 15 wherein the cavity further comprises a removable sleeve comprising a sleeve cavity comprising the at least one battery.

23. The method of claim 22 wherein the storage container further comprises a sleeve gasket disposed between the container body and the removable sleeve, wherein the removable sleeve comprises a sleeve groove extending about a perimeter of the removable sleeve and further wherein the sleeve gasket is seated in the sleeve groove.

* * * * *